US005516421A

United States Patent [19]

Brown et al.

[11] Patent Number: 5,516,421

[45] Date of Patent: May 14, 1996

[54] SULFUR REMOVAL

[76] Inventors: Warren E. Brown, 1314 Mill Cir., Ocean Springs, Miss. 39564; Dennis L. Holtermann, 55 Pennington Ct.; John V. Heyse, 190 Duperu Dr., both of Crockett, Calif. 94525

[21] Appl. No.: 291,810

[22] Filed: Aug. 17, 1994

[51] Int. Cl.[6] ..... C10G 35/08

[52] U.S. Cl. ..... 208/140; 208/48 AA; 208/208 R; 208/209; 208/138

[58] Field of Search ..... 208/48 R, 140, 208/209, 213, 138, 48 AA, 208 R

[56] References Cited

U.S. PATENT DOCUMENTS

| | | | |
|---|---|---|---|
| 3,732,123 | 5/1973 | Stolfa et al. | 134/19 |
| 4,155,836 | 5/1979 | Collins et al. | 208/139 |
| 4,377,495 | 3/1983 | Tse | 502/53 |
| 4,404,087 | 9/1983 | Reed et al. | 208/48 AA |
| 4,507,397 | 3/1985 | Buss | 502/38 |
| 4,940,532 | 7/1990 | Peer et al. | 208/138 |
| 5,035,792 | 7/1991 | Foutsitzis et al. | 208/138 |
| 5,322,615 | 6/1994 | Holtermann et al. | 208/91 |

FOREIGN PATENT DOCUMENTS

WO92/15653 9/1992 WIPO .

*Primary Examiner*—Asok Pal
*Assistant Examiner*—Bekir L. Yildirim
*Attorney, Agent, or Firm*—W. Priester

[57] ABSTRACT

A process for reducing the amount of down time or yield loss associated with a sulfur upset when using a sulfur-sensitive catalyst. The process comprises applying a metallic coat, cladding, plating or paint to a reactor system which comprises a base metal, so as to form an adherent metallic layer on the base metal and thereby produce a metal-coated reactor system; loading a sulfur-sensitive catalyst into the system; and, after a sulfur upset, using a process comprising sulfur stripping to remove sulfur contaminants from the metal-coated reactor system.

29 Claims, No Drawings

SULFUR REMOVAL

FIELD OF THE INVENTION

The present invention is a method of reducing the down time or yield loss associated with sulfur contamination of a reactor system after a sulfur upset. It is also a method of removing sulfur contaminants from a metal-coated reactor system used for hydrocarbon conversion.

BACKGROUND OF THE INVENTION

The need to remove sulfur from sulfur-contaminated catalysts, such as reforming catalysts, and from sulfur-contaminated reactor walls (e.g., iron sulfide scale) is well known. A sulfur-contaminated reactor system, will continue to produce sulfur compounds (such as $H_2S$) under reducing conditions for an extended period of time, sometimes lasting several days. These sulfur compounds can decrease catalyst performance, including activity, stability and/or selectivity.

The problems associated with this sulfur contamination have been addressed in numerous patents and in a variety of ways. For example, U.S. Pat. No. 4,507,397 to Buss teaches a method of regenerating catalysts in sulfur contaminated vessels, piping, etc, where iron sulfide scale has built up during processing. The method uses an in-situ oxidation step using a dry oxygen-containing gas to form oxides of sulfur. Alternatively, U.S. Pat. No. 3,732,123 to Stolfa teaches the descaling of heater tubes by alternately subjecting the deposited scale to oxidation and reduction techniques. Preferably, more than one series of alternating oxidation and reduction steps are used, the later ones being carried out at temperatures from about 1050° F. to about 1250° F. Recently, several patents have issued on methods for cleaning reactor systems prior to using a highly sulfur-sensitive catalysts, such as Pt L-zeolite. For example, U.S. Pat. No. 4,940,532 to Peer et al. discloses a method of preparing a previously used reactor for use with a sulfur-sensitive catalyst. Peer uses a sacrificial particle bed of Pt/Sn and manganese oxide to remove contaminants, such as sulfur, from a conversion system. Subsequently, the sacrificial particle bed is replaced by a sulfur-sensitive catalyst, such as a reforming catalyst selective for dehydrocyclization. Also, U.S. Pat. No. 5,035,792 to Foutsitzis et al. discloses that a hydrocarbon solvent, preferably an aromatic solvent, can be utilized to purge contaminants, such as sulfur, from a conversion system. This process fills the system with an aromatic solvent, such as toluene, to purge sulfur compounds from the reactor walls. It is taught that gases which "are inert to reaction with the solvent or contaminant," such as nitrogen or hydrogen, may be combined with the solvent (see Col. 4, lines 63–9). Additional contaminant-removal steps such as oxidation, reduction, and contaminant removal with a sacrificial particulate bed are also disclosed. This solvent purge is intended to avoid deactivation of a subsequently loaded contaminant sensitive catalyst, such as a reforming catalyst selective for dehydrocyclization. The need to recover the activity of catalysts poisoned by feed sulfur is also well known. For example, U.S. Pat. No. 4,155,836 to Collins et al. discloses that Pt halogen-containing reforming catalysts can be deactivated by feeds containing high levels of sulfur (at least 10 ppm) and water (at least 50 ppm). The resulting contaminated catalysts may have their activity restored by discontinuing the hydrocarbon feed and passing hydrogen and halogen over the catalyst to reduce its sulfur concentration. The typical feed to this process generally has a relatively high sulfur level (between about 1 and 5 ppm). Therefore, the impact of sulfur contamination due to reaction of contaminated process equipment is not observed or discussed.

Additionally, Heyse et al., (WO 92/15653) teach coating portions of reforming reactors with metallic coats to prevent carbonization, coking and metal dusting. A preferred coating for this use is a tin coating. Also, U.S. Ser. No. 000,285 to Heyse et al. teach applying metallic coats to sulfur-contaminated reactors as a method of treating and desulfiding sulfided steels. These patent applications do not address the problem of sulfur upsets, such as that associated with inadvertent sulfur contamination of hydrocarbon feeds.

Indeed, none of the above-described patents disclose a process for quickly and easily removing sulfur contaminants from process equipment, especially from a metal-coated reactor system. Nor do they teach or suggest the advantages associated with the various embodiments of the present invention as described below.

SUMMARY OF THE INVENTION

In one aspect, the present invention is a process to remove sulfur from a metal-coated reactor system that has been contaminated with sulfur.

Sulfur upsets, such as those associated with inadequate feed desulfurization, are known to occur in commercial hydrocarbon conversion processes. They can result in inadvertently high levels of sulfur contaminants, generally in the form of sulfur-containing compounds, being introduced into the reactor system. This sulfur upon contacting the process equipment results in undesirable sulfur contamination of the unit's metallurgy.

For sulfur-sensitive catalysts, sulfur contamination leads to decreased catalyst performance. The present invention minimizes this problem by utilizing a metal-coated reactor system and a sulfur stripping step after a sulfur upset. A preferred sulfur stripping step uses hydrogen as a stripping gas.

Among other factors, this invention is based on our discovery that a relatively simple and inexpensive procedure can be used to quickly and efficiently remove sulfur from reactors that have been coated with certain metallic coats, such as a tin coating. Thus, it has unexpectedly been found that—unlike the iron-containing steels used in standard reforming reactors—when the metal-coated reactor systems of this invention are contaminated with sulfur or sulfur-containing compounds, the undesirable sulfur can be readily removed by treating the reactor system with a sulfur stripping gas, preferably a gas that reacts with the sulfur contaminant, i.e., a reactive gas such as hydrogen.

Aside from simplicity and low cost, our invention has several other advantages. It minimizes the possibility of damaging the metallic coating, which may also serve other purposes; for example, the coating may also be useful in preventing coking, carburization and metal dusting. Also, the process does not require any additional safety procedures; it does not require any additional (hazardous) chemicals (thus minimizing disposal costs), instead it can utilize chemicals that are already used (and therefore readily available) in the hydrocarbon conversion process. Moreover, the process results in rapid decontamination of the reactor system, thus increasing the on-stream time for the unit. Also, for catalysts that are reversibly poisoned by sulfur, it can be used to rapidly remove sulfur without removing catalyst.

The art discussed above is either directed to other processes or to other systems, such as sulfur removal from steel reactors previously used in a different service. It does not teach or suggest a method of recovering from sulfur upsets in metal-coated reactors. Moreover, it shows that costly, corrosive and/or complex processing steps have heretofore been necessary to remove sulfur contaminants from process equipment. In contrast, we have surprisingly found that with metal-coated reactor systems, a simple sulfur stripping step quickly and effectively reduces sulfur contaminant levels in the reactor system.

In one embodiment, the invention is a process for reducing the down time or yield loss associated with a sulfur upset, comprising:

a) applying a metallic coat, cladding, plating or paint to a reactor system which comprises a base metal, so as to form an adherent metallic layer on the base metal and thereby produce a metal-coated reactor system;

b) loading a sulfur-sensitive catalyst into the system; and c) after a sulfur upset, using a process comprising sulfur stripping to remove sulfur from the metal-coated reactor system.

In another embodiment, the invention is a process to remove sulfur from a metal-coated reactor system that has been contaminated with sulfur. This process comprises contacting the contaminated surfaces of the metal-coated reactor system with a substantially sulfur-free, reactive gas for a time and at a temperature sufficient to reduce the sulfur concentration at the reactor outlet by at least 50%, preferably by at least 75% and more preferably by at least 90%.

One especially preferred process of the invention removes sulfur from a sulfur-contaminated, tin-coated reactor system containing a highly sulfur-sensitive catalyst (e.g., Pt on L-zeolite) that has suffered a sulfur upset. The process includes the steps of:

a) removing the highly sulfur-sensitive catalyst from a tin-coated reactor system;

b) adding a sulfur sorbent (e.g., K on alumina) to the reactor system; and c) contacting the contaminated surfaces of the tin-coated reactor system with hydrogen and sorbing contaminant sulfur at conditions of time and temperature sufficient to reduce the sulfur concentration at the system outlet to below 100 ppb, preferably below 10 ppb.

DETAILED DESCRIPTION OF THE INVENTION

In one broad aspect, the present invention is a process which comprises contacting sulfur-contaminated surfaces of a metal-coated reactor system with a substantially sulfur-free gas that is reactive towards or displaces the sulfur contaminants (e.g., metal sulfides). In one preferred embodiment, the contacting is done in the absence of significant amounts of hydrocarbons. In another preferred embodiment, the contacting is done under conditions of reduced hydrocarbon conversion.

The facile sulfur removal process of this invention is especially useful for systems where sulfur upsets result in decreased catalyst selectivity, stability and/or activity. This process is therefore attractive for a variety of hydrocarbon conversion processes utilizing sulfur-sensitive catalysts, especially noble metal catalysts. These include for example, catalytic reforming using conventional Pt/Re or Pt/Sn or Pt/Ir on alumina catalysts; or Pt catalyzed hydrocarbon isomerization or hydroisomerization processes; or Pt, Pd, or other noble metal catalyzed hydrogenation/dehydrogenation processes including selective hydrogenations of dienes such as butadiene.

In these instances, the process of this invention gives more rapid recovery of catalyst selectivity and/or activity after a sulfur upset.

Although the terms "comprises" or "comprising" are used throughout this specification, these terms are intended to encompass both the terms "consisting essentially of", and "consisting of" in various preferred aspects and embodiments of the present invention.

As used herein, the term "reactor system" is intended to include hydrocarbon conversion units that have one or more hydrocarbon conversion reactors, their associated piping, heat exchangers, furnace tubes, etc. For processes using catalysts that are irreversibly poisoned by sulfur, a sulfur converter reactor (for converting organic sulfur compounds to $H_2S$) and a sulfur sorber reactor (for adsorbing and/or absorbing $H_2S$) are usually also included in the reactor system; these reactors can be combined together into a converter/sorber reactor, or can be combined with other parts of the system, such as the conversion reactors.

As used herein, the term "metal-coated reactor system" is intended to include reactor systems (see above) having a metallic coat, cladding, plating, or paint applied to at least a portion (preferably at least 50%, more preferably at least 75%) of the surface area that is to be contacted with hydrocarbons at process temperature. This metal-coated reactor system comprises a base metal (such as carbon, chrome, or stainless steels) having one or more adherent metallic layers attached thereto.

As used herein, the term "sulfur stripping" is intended to include methods of removing sulfur contaminants (sulfur, sulfur-containing compounds, and metal sulfides) from metal-coated surfaces. Sulfur stripping is preferably done with a gas or mixture of gases, preferably a gas that reacts with the sulfur contaminant(s) at sulfur stripping conditions.

These conditions depend on the particular metallic coating as well as the hydrocarbon conversion process to which the invention is applied.

Not all metallic coats are useful in this invention. Metallic coats that are substantially inert to sulfur at the intended hydrocarbon conversion conditions are especially useful. Thus, metals that resist sulfiding at process conditions are useful. These metals include aluminum, titanium, niobium, zirconium, tantalum and hafnium. Metallic coatings of these metals can be applied by techniques well known in the art, such as sputtering.

Other useful metallic coats are selected from among metallic coats that reject sulfur from their surfaces more rapidly or at lower temperatures than iron at sulfur stripping conditions. One way to identify which coatings are useful is shown in Example 4, below. Here the metal sulfide, or preferably the sulfided metallic coat, is tested (in the example a hydrogen stripping process is used) and compared to sulfided carbon steel, preferably compared to iron sulfide. Useful coatings strip more rapidly than iron sulfide at stripping conditions. There are numerous variations on this test, as will be evident to those skilled in the art. Preferred coatings are often less reactive toward sulfur than iron at sulfur stripping conditions.

Useful metallic coats include those selected from among tin, germanium, antimony, arsenic, bismuth, aluminum, gallium, indium, copper, lead and mixtures and alloys thereof. Preferred coatings include tin-, germanium-, and antimony-containing coatings. These coatings all form strong adherent coats and sulfur can be readily stripped from their surfaces. Tin coatings are especially preferred—they are easy to apply to steel, are inexpensive and are environmentally benign.

Metallic coatings that are less useful include coatings of cobalt, nickel, molybdenum, tungsten and chromium. It is believed that these coatings, when sulfided, would give off sulfur (e.g. $H_2S$) for extended periods of time.

It is preferred that these coats/coatings be sufficiently thick and uniform that they completely cover the base iron metallurgy and remain intact over years of operation. Significant amount of uncoated steel could result in iron sulfide scale or other sulfur contamination. This will slowly lose sulfur and increase the time needed to recover from the sulfur upset. It is desirable that the coating be firmly bonded to the steel. For preferred metallic coatings, this can be accomplished, for example, by curing the applied coating at elevated temperatures.

Metallic coatings can be applied in a variety of ways, which are well known in the art, such as electroplating, chemical vapor deposition, and sputtering, to name just a few. Preferred methods of applying coatings include painting and plating. Where practical, it is preferred that the coating be applied in a paint-like formulation (hereinafter "paint"). Such a paint can be sprayed, brushed, pigged, etc. on reactor system surfaces. The metal or metal compounds contained in the plating, cladding or other coating are preferably cured under conditions effective to produce molten metals and/or compounds. Thus, germanium and antimony paints are preferably cured between 1000° F. and 1400° F. Tin paints are preferably cured between 900° F. and 1100° F. Preferred metallic coats such as those derived from paints, are preferably produced under reducing conditions. Reduction/curing is preferably done using hydrogen, and preferably in the absence of hydrocarbons.

Some preferred coatings are described in U.S. Ser. No. 803,063 to Heyse et al., corresponding to WO 92/15653, which is incorporated herein by reference in its entirety. This application also describes some preferred paint formulations.

A preferred coating is prepared from a tin-containing paint. One preferred paint is a decomposable, reactive, tin-containing paint which reduces to a reactive tin and forms metallic stannides (e.g., iron stannides and nickel/iron stannides depending on the steel) upon heating in a reducing atmosphere (e.g., an atmosphere containing hydrogen). One especially preferred tin paint contains at least four components or their functional equivalents: (i) a hydrogen decomposable tin compound, (ii) a solvent system, (iii) finely divided tin metal and (iv) tin oxide. As the hydrogen decomposable tin compound, organometallic compounds such as tin octanoate or neodecanoate are particularly useful. Component (iv), the tin oxide is a porous tin-containing compound which can sponge-up the organometallic tin compound, yet still be reduced to metallic tin.

Paints preferably contain finely divided solids to minimize settling. Finely divided tin metal, component (iii) above, is also added to insure that metallic tin is available to react with the surface to be coated at as low a temperature as possible, even in a non-reducing atmosphere. The particle size of the tin is preferably small, for example one to five microns.

In one embodiment, there can be used a tin paint of Tin Ten-Cem (contains 20% tin as stannous octanoate in octanoic acid or stannous neodecanoate in neodecanoic acid), stannic oxide, tin metal powder and isopropyl alcohol. When tin paints are applied at appropriate thicknesses, initial reduction conditions will result in tin migrating to cover small regions (e.g., welds) which were not painted. This will completely coat the base metal. Preferred tin paints form strong adherent coats upon curing.

As an example of a suitable paint cure for a tin paint, the system including painted portions can be pressurized with $N_2$, followed by the addition of $H_2$ to a concentration greater than or equal to 50% $H_2$. The reactor inlet temperature can be raised to 800° F. at a rate of 50°–100° F./hr Thereafter the temperature can be raised to a level of 950°–975° F. at a rate of 50° F./hr, and held within that range for about 48 hrs. Curing can also be achieved in pure $H_2$ at 1000° F to 1200° F. for 2–24 hours.

After observing that a sulfur upset has occurred, it is best to eliminate the source of sulfur contamination. Thereafter, though not required, it is preferred to purge the metal-coated reactor system with clean feed or with a substantially sulfur-free gas. Optionally, the system is washed with an organic solvent, preferably a hydrocarbon, especially if the source of contamination is a high boiling point oil.

The process of this invention uses a substantially sulfur-free gas. As used herein, the terms "substantially sulfur-free" gas or "sulfur-free" gas are meant to encompass a gas or mixtures of gases containing low concentrations of sulfur-containing compounds. Although it is preferred to use a gas with no detectable sulfur (i.e., below about 5 ppb) this term is also intended to encompass gasses having less than 1 ppm sulfur, preferably less than 500 ppb, more preferably less than 100 ppb and most preferably less than 50 ppb sulfur. Additionally, in circumstances where sulfur upsets result in high sulfur levels, such as 10 to 50 ppm, a "substantially sulfur-free gas" to include a gas having a sulfur content that is at least an order of magnitude less than the contaminant sulfur level, i.e., sulfur levels of between about 1 and 5 ppm.

The substantially sulfur-free gas is preferably also free of oxygen-containing and nitrogen-containing contaminants, such as $NH_3$ or water.

Gases containing sulfur compounds and other contaminants can be treated to produce a substantially sulfur-free gas. Those skilled in the art will appreciate that a variety of treatment methods, including drying, hydrotreating, mild reforming and sorption processes, to name a few, are well known for this purpose.

The sulfur-free gas is used to strip or remove the sulfur contaminants from the reactor system. This gas is preferably a reactive gas, that is, one that reacts with sulfur-containing compounds or species. Thus, it is preferably selected from among hydrogen, hydrogen halides (such as HCl or gases that produce HCl) and carbon monoxide as well as combinations thereof, or mixtures of these gases with inert gases, such as hydrocarbons or preferably nitrogen. It is important that the sulfur-free gas be selected so that it not damage or attack the metallic coat. Therefore, the preferred gas varies with the particular type of metallic coating. Generally, the more preferred gases include carbon monoxide, dry hydrogen chloride and hydrogen. An especially preferred sulfur-free, reactive gas is hydrogen. Indeed, the process preferably includes a step where a hydrogen-containing gas is used to strip sulfur from the reactor system, i.e., a "hydrogen stripping" step.

The amount of the stripping gas (herein exemplified by hydrogen) needs to be sufficient to react with contaminant sulfur and achieve the required degree of sulfur removal. The hydrogen can be pure hydrogen or hydrogen diluted in an inert (and, of course, preferably sulfur-free) gas. A preferred gas is a hydrogen/nitrogen mixture, for example, one containing 1 to 90 volume percent hydrogen in nitrogen, preferably 5 to 50% hydrogen in nitrogen, more preferably containing 10 to 30% hydrogen. Mixtures of hydrogen with heavier gases have increased heat capacity compared to pure hydrogen, and therefore are advantageous in achieving preferred stripping temperatures compared to pure hydrogen.

In one preferred embodiment, the hydrogen after passing through the reactor system also passes through a sulfur sorbent and is recycled. Thus, the effluent hydrogen containing sulfur compounds is desulfurized and reused as a stripping gas. Thus, in one preferred embodiment a sulfur sorption step is part of the sulfur stripping process.

Preferred sulfur sorbents are those that are highly effective in removing sulfur upon contact, such as those containing manganese oxide, Cu, Ni, or K on alumina or clay. These sulfur sorbents and operating conditions for their use are well known in the art. The sorbent can be located inside the reactor system or ex-situ, for example, in the hydrogen recycle loop. A preferred sulfur sorbent for use inside the reactor system is K on alumina, in part because it is compatible with the temperatures used during the sulfur stripping step. A preferred sulfur sorbent for use ex-situ is copper, in part because of the ease of handling, or nickel on alumina or on silica/aluminum because of its large sorption capacity.

In general, the process of this invention contacts the metal-coated reactor system with the substantially sulfur-free gas for a time and at a temperature sufficient to desulfide the metallic coating. This can be determined, for example, by measuring the sulfur concentration at the system outlet. This invention reduces the outlet sulfur concentration significantly, i.e., by at least 50%, preferably by at least 75%, and more preferably by at least 90% from that measured prior to sulfur stripping. It is preferred that the outlet sulfur concentration be within the preferred range for the catalyst used.

Thus, for systems using catalysts that are reversibly poisoned by sulfur, it is preferred that the amount of sulfur at the reactor outlet after stripping be low enough that it does not significantly reduce catalyst performance. This amount of sulfur depends on the specific catalyst. Generally it is preferred that the effluent sulfur level be below about 1 to 5 ppm, preferably below 500 ppb, and for some catalysts, more preferably below 200 ppb.

Sulfur levels in the feed and at the reactor outlet can be measured in a variety of ways well known in the art. These include lead acetate paper devices (e.g. Tracor Atlas) and gold film sensors (Jerome analyzer).

For systems using catalysts that are irreversibly poisoned by sulfur, such as Pt L zeolite dehydrocyclization catalysts, it is preferred that the sulfur at the reactor outlet after stripping be below about below 50 ppb, preferably below 10 ppb. Depending on the sulfur sensitivity of the catalyst, the catalyst may be unloaded prior to the stripping step. This is generally preferred if the catalyst is irreversibly poisoned by sulfur.

For irreversibly poisoned catalysts, the catalysts and/or sorbents in the reactor system are replaced, if necessary, after sulfur stripping is completed. Fresh feed is then passed through the desulfided reactor system over the sulfur-sensitive catalyst and converted to product.

The sulfur stripping step is preferably done at elevated temperatures to speed sulfur removal. Preferably the temperature is at least equal to the normal operating temperature at which the sulfur-sensitive catalyst is used. Thus, it is preferred that the residual sulfur compounds in the process equipment be treated with the stripping gas (e.g., hydrogen) at temperatures at least as high as those planned for plant use (e.g., 800° F., preferably between 850° F. and 1025° F. for reforming). Typical times and temperatures for the sulfur stripping step for a reforming reactor system using a Pt L zeolite are between about 8 and 48 hrs at about 1000° F. This step is preferably done at as high a gas rate as the process equipment allows to speed sulfur removal. Typically the gas hourly space velocity (GHSV)is between 100 and 10,000 $hr^{-1}$, more preferably between 1000 and 3000 $hr^{-1}$.

The present invention is useful with a wide range of noble metal catalysts that are poisoned or partly or wholly inactivated by sulfur (e.g., catalysts containing Pt, Pd, Rh, Ir, Ru, Os), especially Pt containing catalysts. These catalysts are usually supported, for example, on carbon, on a refractory oxide support, such as silica, alumina, chlorided alumina or on a molecular sieve / zeolite. Indeed, any process that uses a sulfur-sensitive catalysts can benefit from this invention. Preferred catalysts include platinum on alumina, Pt/Sn on alumina and Pt/Re on chlorided alumina; noble metal Group VIII catalysts supported on a zeolite such as Pt, Pt/Sn and Pt/Re on zeolites, including L type zeolites, ZSM-5, SSZ-25, SAPO's, silicalite and beta.

Especially preferred catalysts for use in this invention are those that are irreversibly poisoned by sulfur, and are therefore highly sensitive to sulfur. These catalysts include Group VIII metals on large pore zeolites, such as L zeolite catalysts containing Pt, preferably Pt on non-acidic L zeolite.

A preferred embodiment of the invention involves the use of a medium-pore size or large-pore size zeolite catalyst including an alkali or alkaline earth metal and charged with one or more Group VIII metals. Most preferred is the embodiment where such a catalyst is used in reforming or dehydrocyclization of a paraffinic naphtha feed containing $C_6$, and/or $C_8$ hydrocarbons to produce aromatics.

By "intermediate pore size" zeolite is meant a zeolite having an effective pore aperture in the range of about 5 to 6.5 Angstroms when the zeolite is in the H-form. These zeolites allow hydrocarbons having some branching into the zeolitic void spaces and can differentiate between n-alkanes and slightly branched alkanes compared to larger branched alkanes having, for example, quaternary carbon atoms. Useful intermediate pore size zeolites include ZSM-5 described in U.S. Pat. Nos. 3,702,886 and 3,770,614; ZSM-11 described in U.S. Pat. No. 3,709,979; ZSM-12 described in U.S. Pat. No. 3,832,449; ZSM-21 described in U.S. Pat. No. 4,061,724; and silicalite described in U.S. Pat. No. 4,061,724. Preferred zeolites are silicalite, ZSM-5, and ZSM-11. An especially preferred Pt on zeolite catalyst is described in U.S. Pat. No. 4,347,394 to Detz et al.

By "large-pore size zeolite" is meant a zeolite having an effective pore aperture of about 6 to 15 Angstroms. Preferred large pore zeolites which are useful in the present invention include type L zeolite, zeolite X, zeolite Y and faujasite. Zeolite Y is described in U.S. Pat. No. 3,130,007 and Zeolite X is described in U.S. Pat. No. 2,882,244. Especially preferred zeolites have effective pore apertures between 7 to 9 Angstroms.

The composition of type L zeolite expressed in terms of mole ratios of oxides, may be represented by the following formula:

$$(0.9\text{–}1.3)M_{2/n}O:Al_2O_3(5.2\text{–}6.9)SiO_2:yH_2O$$

In the above formula M represents a cation, n represents the valence of M, and y may be any value from 0 to about 9. Zeolite L, its X-ray diffraction pattern, its properties, and methods of preparation are described in detail in, for example, U.S. Pat. No. 3,216,789, the contents of which is hereby incorporated by reference. The actual formula may vary without changing the crystalline structure. Useful Pt on L zeolite catalysts also include those described in U.S. Pat. No. 4,634,518 to Buss and Hughes, in U.S. Pat. No. 5,196,631 to Murakawa et al., in U.S. Pat. No. 4,593,133 to Wortel and in U.S. Pat. No. 4,648,960 to Poeppelmeir et al., all of which are incorporated herein by reference in their entirety.

In a preferred embodiment, an alkali or alkaline earth metal is present in the large-pore zeolite. Preferred alkali metals include potassium, cesium and rubidium, more preferably, potassium. Preferred alkaline earth metals include barium, strontium or calcium, more preferably barium. The alkaline earth metal can be incorporated into the zeolite by synthesis, impregnation or ion exchange. Barium is preferred to the other alkaline earths because it results in a somewhat less acidic catalyst. Strong acidity is undesirable in some catalysts because it promotes cracking, resulting in lower selectivity. Thus for some applications, it is preferred that the catalyst be substantially free of acidity.

The zeolitic catalysts used in the invention are charged with one or more Group VIII metals, e.g., nickel, ruthenium, rhodium, palladium, iridium or platinum. Preferred Group VIII metals are iridium and particularly platinum. If used, the preferred weight percent platinum in the catalyst is between 0.1% and 5%. Group VIII metals can be introduced into zeolites by synthesis, impregnation or exchange in an aqueous solution of appropriate salt. When it is desired to introduce two Group VIII metals into the zeolite, the operation may be carried out simultaneously or sequentially.

When the present invention is used with catalysts that are reversibly poisoned by sulfur, such as most Pt catalysts, the catalyst can be retained in the metal-coated reactor system during sulfur stripping. The stripping can be done under typical operating conditions, or done under conditions of significantly reduced hydrocarbon conversion. This can be accomplished for example by decreasing the feed rate or the reactor temperature. In a preferred embodiment, the amount of feed sent to the catalyst is reduced, or even stopped altogether.

When the invention is used with catalysts that are highly sulfur-sensitive and irreversibly poisoned by sulfur, such as Pt L zeolite catalyst, the partially or wholly sulfur contaminated catalyst is usually removed from the sulfur-contaminated, metal-coated reactor system before sulfur stripping. In a preferred embodiment, it is replaced in part with a sulfur converter and a sorbent to trap sulfur compounds during stripping. (The irreversibly poisoned catalyst can itself be used as the sulfur sorbent, if it still has sufficient sulfur sorption capacity. However, this is not usually economically attractive).

One or more sulfur sorbents are generally used in conjunction with highly sulfur-sensitive catalysts; for simplicity these sorbents can be used. For the sulfur stripping step, the sorbent can be placed in various locations in the reactor system. For example, it can be placed in the hydrocarbon conversion reactors, e.g. in some of the catalyst beds. In a preferred embodiment, it is placed in the location in the reactor system where sorbent is usually placed, for example, the converter/sorber reactor. If the sorbent's sulfur trapping capacity is high enough, it is not necessarily to remove the sorbent after the sulfur stripping step, that is, it can be left in place as part of reloading the reactor system with catalyst. This simplifies start-up procedures and reduces costs. Alternatively, the sulfur sorbent after the stripping step can be replaced with clean sorbent to ensure maximum sorbent life.

The amount of needed sorption capacity for the stripping step can be readily estimated. For example, the sulfur contaminated metal surface area can be estimated, and from that, the amount of sulfur contaminant. Excess sorbent, to ensure complete sulfur sorption is generally preferred. It is best to monitor the sulfur level exiting the sorbent. It should be replaced if any sign of sulfur breakthrough is evident.

After the sulfur stripping step, fresh hydrocarbon conversion catalyst or the catalyst removed from the reactors is loaded into the reactors—which type of catalyst is used depends on the extent of sulfur poisoning; generally fresh catalyst is used. After slowly heating to operating temperature, preferably in dry hydrogen, hydrocarbons are fed to the catalyst. Successful sulfur stripping is evidenced by catalyst performance, e.g. a low catalyst fouling rate, which is consistent with minimal sulfur poisoning of the catalyst due to residual sulfur contaminants.

The present invention is useful in hydrocarbon conversion processes that are operated in conjunction with sulfur removal processes or under reduced or low-sulfur conditions using a variety of sulfur-sensitive catalysts. These processes are well known in the art. These processes generally require some feed cleanup, such as hydrotreating and/or sulfur sorption. They include catalytic reforming and/or dehydrocyclization processes, such as those described in U.S. Pat. No. 4,456,527 to Buss et al. and U.S. Pat. No. 3,415,737 to Kluksdahl; catalytic hydrocarbon isomerization processes such as those described in U.S. Pat. No. 5,166,112 to Holtermann; and catalytic hydrogenation/dehydrogenation processes.

To obtain a more complete understanding of the present invention, the following examples illustrating certain aspects of the invention are set forth. It should be understood, however, that the invention is not intended to be limited in any way to the specific details of the examples.

EXAMPLES

Example 1

Sulfur Removal From a Tin-Coated Reactor System

This experiment was done in a reforming pilot plant, which included a sulfur converter/sulfur sorber reactor, a reforming reactor and a recycle gas drier. The sulfur converter portion converted organic sulfides to compounds readily sorbed by the sulfur sorbent. The reforming reactor was coated with a tin-containing paint. The paint consisted of a mixture of tin oxide, finely powdered tin, a tin alkyl carboxylate and isopropanol solvent as described in WO 92/15653. The coating was applied by painting. After drying, it was reduced at 1000° F. for 24 hours in $H_2$.

The reactor system was contaminated with sulfur, such that $H_2S$ was detected in the reactor effluent. Since this pilot plant was to be used to evaluate an extremely sulfur sensitive Pt L zeolite catalyst, all sulfur had to be removed from the plant before catalyst testing.

Sulfur removal was accomplished as follows. First the source of the sulfur contamination was eliminated. Then the unit was purged at planned reaction conditions (100 psig, 1.6 LHSV, 1000° F.) with clean, substantially sulfur-free feed for approximately 1 day. Feed was then stopped, the reactor cooled and purged with nitrogen. The reforming catalyst was then dumped. A sulfur sorbent (K on alumina) was loaded into the reforming reactor and the recycle gas drier. This sorbent was also loaded into the sulfur converter/sorber reactor upstream of the reforming reactor; here, on top of the sorbent a small amount of Pt on alumina (sulfur converter catalyst) was placed. This Pt catalyst was used to convert any organic sulfur to $H_2S$ for subsequent removal by downstream sorbent.

The plant was pressured/depressured 3 times with $N_2$ to remove oxygen. Hydrogen was then added until the pressure reached about 100 psig, at which point the recycle compressor was started. The $H_2$ recycle rate was adjusted to about 2000 scc/min (GHSV=1500) with the flow directed through the sulfur converter/sorber reactor, the reforming reactor and the recycle gas drier. The reforming reactor was then heated to 1000° F. and the reactor containing the sulfur sorbent and the sulfur converting catalyst was heated to 650° F. The reactors were held at these temperatures for 2 days at the above flow rate. Feed was then introduced (along with hydrogen) at 1.6 LHSV and 1000° F., and run for another 2 days.

After this sulfur removal process was completed, the reforming reactor was charged with 80 cc of fresh Pt L zeolite catalyst, the recycle drier was charged with fresh 4A sieve, and a fouling rate test was conducted. The fouling rate for this catalyst is highly dependent on the sulfur contaminant level. Test conditions were: a desulfurized $C_{6-C8}$ paraffinic feed, 1.6 LHSV, $3H_2$/HC and 100 psig. The temperature of the catalyst was adjusted as necessary to maintain 46.5 wt % aromatics in the C5+ liquid product. The fouling rate was 0.03° F./hr. This was only somewhat higher than the fouling rate of 0.02° F./hr obtained in a similar pilot plant that had not been sulfur contaminated. These results show that sulfur could be effectively removed from the plant using these simple procedures. Surprisingly, acid washing or grit blasting was not necessary.

Comparative Example 1A

Sulfur Removal from a Stainless Steel Reactor System

A stainless steel sulfur-contaminated pilot plant (no metal coating) was cleaned as follows. The unit was purged with sulfur-free feed for >1 day. Then the feed was stopped, the reactor was cooled and the reforming catalyst was dumped. The reforming reactor was grit blasted and then washed with dilute hydrochloric acid. This reactor was then charged with a K on alumina sulfur sorbent.

The sorbent was also charged to a converter/sorber reactor upstream of the reforming reactor. On top of the sorbent was placed a small amount of Pt on alumina. Hydrogen was then added to the pilot plant until the pressure reached approximately 100 psig, at which point the recycle compressor was started. The $H_2$ recycle rate was adjusted to about 2000 scc/min with the flow directed through the sulfur converter/sorber reactor, the reforming reactor and the recycle gas drier. The reforming reactor was then heated to 1000° F. and the reactor containing the sulfur converter/sorber was heated to 650° F. The reactors were held at this temperature for 2 days. Then feed was introduced at 1.6 LHSV and run for another 2 days maintaining constant recycle of GHSV=1500.

After the above sulfur removal was completed, the pilot plant reforming reactor was dumped and charged with 80 cc of fresh Pt L zeolite catalyst. A standard fouling rate test conducted. Test conditions were substantially the same as in Example 1. The fouling rate was 0.04° F./hr. This was significantly higher than that in Example 1, and shows the difficulty of removing sulfur from stainless steel reactors.

Example 2

Large Scale Test

A sulfur removal process of this invention was tested in a large reforming reactor system employing a sulfur-sensitive Pt L zeolite catalyst. The reforming reactor system contained a feed sulfur sorber containing Ni on alumina sorbent, a converter reactor (Pt on alumina) followed by a second sulfur sorber reactor (K on alumina), for reducing sulfur to ultra low levels in the combined feed and recycle gas stream, and then 4 reforming reactors containing a Pt L zeolite catalyst. Also included were interheaters and a recycle gas drier. The reforming reactors and furnaces were initially coated with the tin coating described in Example 1.

After months on-stream, the unit experienced a severe sulfur upset which saturated the sulfur converter-sorber, the Pt L zeolite catalyst, and the molecular sieve in the recycle gas drier. Subsequently the unit was cooled and the contaminated Pt on alumina, K on alumina, and the Pt L zeolite catalysts were removed. Fresh K on alumina sorbent was then charged to the sorber reactor. The converter-sorber reactors were purged with $N_2$, isolated from the rest of the plant, and pressured to about 50 psig. Since the recycle gas driers containing 4A sieve were sulfur contaminated, they were also regenerated by heating to 500° F. with sulfur-free fuel gas until the exit gas contained <1 ppm sulfur.

Next, the reforming reactors and recycle gas loop were purged with nitrogen, pressured to 50 psig and the recycle gas compressor started. The reactors were then heated to 300° F. at which point the converter-sorber was put on line. Electrolytic hydrogen was then added until >20 vol % hydrogen was achieved in the reactor and recycle gas loop. Gradually the reactors were heated to 950° F. over two days. The unit was held at 950° F. until the effluent exiting the last of the reactors had a sulfur level of <5 ppb (about 2 days). The plant was then cooled, and the K on alumina sorbent was discarded from the feed sulfur sorber reactor.

After sulfur stripping, the sorber, converter and reforming reactors were recharged with fresh catalysts and operations restarted. No deleterious effects on catalyst performance were observed, showing that excellent cleanup of the sulfur-contaminant from the metal-coated reactor system was achieved. Achieving this extremely low sulfur effluent level was indicative that the contaminant sulfur could be removed without acid washing or grit blasting.

Example 3

Sulfur Stripping from a Tin-Coated Reactor Containing a Pt/Re Catalyst

A tin-coated reactor system is used to reform a $C_6$ to $C_{10}$ naphtha with a conventional Pt/Re on alumina reforming catalyst. The tin-coated reactor is prepared using the tin paint of Example 1. After several weeks on stream a sulfur upset results in a sulfur level of about 10 ppm in the feed.

The following sulfur removal process is used. First, the source of the sulfur contamination is eliminated. Then the unit is purged to remove excess sulfur. This purge can be accomplished in one of two ways. The first way is to maintain the current operating feed, recycle rates and temperature and allow the sulfur to be purged from the plant with the produced $H_2$, which is also known as the net gas make. This purge is continued until the sulfur content in the last reactor outlet is below 1 ppm, preferably below 200 ppb. The time required for this step will depend on the extent of the sulfur upset and on the net gas production rate. If the net gas rate is not sufficient to purge the sulfur in a time effective manner, then the second way of purging is used. This consists of purging the plant at or somewhat below operating temperature with added $H_2$ at the highest reasonable gas rate. This purge is continued until the sulfur level at the last reactor outlet is below 1 ppm, preferably below 200 ppb.

By using this process in a tin-coated reactor system, the time for sulfur removal is much less that what is currently required in conventional steel (non-metal coated) reactors. And, catalyst performance recovers much faster.

Example 4

Testing of Metal Sulfides

Four materials containing metal sulfides were tested for their ease of sulfur loss. The four materials were:

1. Tin (II) Sulfide ($SnS_2$) powder;
2. Antimony (II) Sulfide ($Sb_2S_3$) powder;
3. Iron (II) Sulfide ($Fe_{1-x}S$) coarse grains; and
4. A sulfided steel (9 Chrome, 1 Molybdenum) containing two phases, iron chromium sulfide $(Fe,Cr)_3S_4$ and fine grained $Fe_{1-x}S$.

These materials were placed in a quartz boat and were heated quickly in a quartz tube furnace to 1100° F. in flowing hydrogen. After two hours the tube was cooled. The materials were examined visually; mounted and polished cross-sections of the materials were examined using petrographic and scanning electron microscopy.

The tin sulfide (1) and antimony sulfide (2), were both readily reduced to native elements under these conditions. The iron sulfide (3) was only partially reduced under these conditions. On the sulfided steel (4), the fine iron sulfide was partially reduced, but the iron chromium sulfide was not reduced.

It is believed that metal sulfides which reduce to metals more easily than iron sulfide—here exemplified by tin and antimony sulfides—will be readily sulfur stripped by hydrogen, and are useful in this invention. In contrast, chromium sulfide does not reduce easily; chromium-coated steels are not useful in this invention.

While the invention has been described above in terms of preferred embodiments, it is to be understood that variations and modifications may be used as will be appreciated by those skilled in the art. Indeed, there are many variations and modifications to the above embodiments which will be readily evident to those skilled in the art, and which are to be considered within the scope of the invention as defined by the following claims.

We claim:

1. A process for reducing the down time or yield loss associated with a sulfur upset, comprising:

a) applying a metallic coat, cladding, plating or paint to a reactor system which comprises a base metal, so as to form an adherent metallic layer on the base metal and thereby produce a metal-coated reactor system;

b) loading a sulfur-sensitive catalyst into the system; and c) after a sulfur upset, using a process comprising sulfur stripping to remove sulfur from the metal-coated reactor system.

2. The process of claim 1 where the metallic coat, cladding, plating or paint is selected from among materials that reject sulfur more rapidly than does iron.

3. The process of claim 1 where the sulfur stripping uses a gas that reacts with sulfur compounds.

4. The process of claim 3 where the sulfur stripping uses a gas containing hydrogen.

5. The process of claim 4 where the sulfur stripping comprises contacting the reactor system with the hydrogen at about process operating temperature and at a GHSV of between 100–10,000 $hr^{-1}$.

6. The process of claim 1 where the sulfur-sensitive catalyst is selected from noble metal catalysts.

7. The process of claim 1 where the sulfur-sensitive catalyst is a Pt containing catalyst.

8. The process of claim 1 where the sulfur-sensitive catalyst is selected from catalysts reversibly poisoned by sulfur.

9. The process of claim 8 where the sulfur-sensitive catalyst is selected from Pt/Sn, Pt/Re, Pt/Ir and Pt on a support selected from alumina, silica or a zeolite.

10. The process of claim 1 where the sulfur-sensitive catalyst is a catalyst that is irreversibly poisoned by sulfur.

11. The process of claim 10 where the sulfur-sensitive catalyst is an L zeolite catalyst containing Pt.

12. The process of claim 1 further comprising sulfur sorption as part of (c).

13. A method of reducing the down time or yield loss associated with a sulfur upset in a reactor system which uses a sulfur-sensitive catalyst for hydrocarbon conversion, comprising the steps of:

a) coating at least a portion of a reactor system with a coating containing a metal that is less reactive toward sulfur than iron at sulfur stripping conditions;

b) converting hydrocarbons in said reactor system using a sulfur-sensitive catalyst; and c) using a hydrogen-containing gas to strip sulfur from said system after a sulfur upset.

14. The method of claim 13 where at least a portion of the hydrogen is desulfurized and recycled.

15. The method of claim 13 where the catalyst contains platinum.

16. The method of claim 13 further comprising removing the sulfur-sensitive catalyst prior to sulfur stripping.

17. The method of claim 13 wherein the hydrocarbon conversion is catalytic reforming or dehydrocyclization.

18. The method of claim 13 wherein the hydrocarbon conversion is catalytic hydrogenation or dehydrogenation.

19. The method of claim 13 wherein the hydrocarbon conversion is catalytic isomerization.

20. A process for removing sulfur from a sulfur contaminated metal-coated reactor system containing a highly sulfur-sensitive catalyst that has suffered a sulfur upset, comprising the steps of:

a) removing the highly sulfur-sensitive catalyst from the reactor system;

b) adding a sulfur sorbent to the reactor system; and c) contacting the contaminated surfaces of the metal-coated reactor system with a substantially sulfur-free gas containing hydrogen and sorbing contaminant sulfur at conditions of time and temperature sufficient to reduce the sulfur concentration at the system outlet to below 100 ppb.

21. The process of claim 20 where the highly sulfur-sensitive catalyst is a type L zeolite containing Pt.

22. The process of claim 21 where the catalyst is non-acidic Pt on L-zeolite.

23. The process of claim 20 where the sulfur concentration at the system outlet is below 50 ppb.

24. The process of claim 20 where the sulfur concentration at the system outlet to below 10 ppb.

25. The process of claim 20 where the metal-coated reactor system is coated with a metal selected from the group consisting of tin, germanium and antimony.

26. The process of claim 25 where the metal-coated reactor system is coated with tin.

27. The process of claim 20 where at least a portion of the hydrogen is desulfurized and recycled.

28. A process to remove sulfur from a metal-coated reactor system that has been contaminated with sulfur, comprising contacting the contaminated surfaces of a metal-coated reactor system with a substantially sulfur-free, reactive gas for a time and at a temperature sufficient to reduce the sulfur concentration at the reactor outlet by at least 50%.

29. The process of claim 28 where the sulfur concentration at the reactor outlet is below 1 ppm.

* * * * *